US010323306B2

(12) United States Patent
Choi et al.

(10) Patent No.: US 10,323,306 B2
(45) Date of Patent: Jun. 18, 2019

(54) AUSTENITIC STEEL MATRIX-NANOPARTICLE COMPOSITE AND PRODUCING METHOD THEREOF

(71) Applicant: Kookmin University Industry Academy Cooperation Foundation, Seoul (KR)

(72) Inventors: Hyunjoo Choi, Seoul (KR); Jonggyu Jeon, Seoul (KR); Seungjin Nam, Uijeongbu-si (KR)

(73) Assignee: KOOKMIN UNIVERSITY INDUSTRY ACADEMY COOPERATION FOUNDATION, Seoul (KR)

( * ) Notice: Subject to any disclaimer, the term of this patent is extended or adjusted under 35 U.S.C. 154(b) by 472 days.

(21) Appl. No.: 14/740,296

(22) Filed: Jun. 16, 2015

(65) Prior Publication Data

US 2016/0130689 A1 May 12, 2016

(30) Foreign Application Priority Data

Nov. 12, 2014 (KR) ..... 10-2014-0157101

(51) Int. Cl.
*C21D 6/00* (2006.01)
*C22C 38/00* (2006.01)

(52) U.S. Cl.
CPC ..... *C22C 38/00* (2013.01); *C21D 6/00* (2013.01)

(58) Field of Classification Search
CPC ..... C21D 6/00; C22C 38/00
USPC ..... 75/246
See application file for complete search history.

(56) References Cited

U.S. PATENT DOCUMENTS 5,908,486 A * 6/1999 Flinn ..... C21D 6/02 148/513
7,662,207 B2 * 2/2010 Miura ..... B22F 1/0044 75/232
2014/0086783 A1 * 3/2014 De Carlan ..... C23C 8/24 419/13

* cited by examiner

*Primary Examiner* — Jie Yang
(74) *Attorney, Agent, or Firm* — Paratus Law Group, PLLC

(57) ABSTRACT

An austenitic steel matrix-nanoparticle composite and a producing method thereof are provided. The composite includes: an austenitic steel matrix that includes an alloying element; and a nanoparticle that grows in situ in the matrix and that is formed in the matrix. The nanoparticle grows from the alloying element included in the austenitic steel matrix. The method includes: preparing an austenitic steel matrix including an alloying element; and heating the austenitic steel matrix. In the method, the nanoparticle grows in situ in the matrix from the alloying element which is solid-dissolved in the austenitic steel matrix by the heating.

1 Claim, 7 Drawing Sheets

AUSTENITIC STEEL MATRIX-NANOPARTICLE COMPOSITE AND PRODUCING METHOD THEREOF

CROSS-REFERENCE TO RELATED PATENT APPLICATION

This application claims the benefit of Korean Patent Application No. 10-2014-0157101, filed on Nov. 12, 2014, in the Korean Intellectual Property Office, the disclosure of which is incorporated herein in its entirety by reference.

BACKGROUND

Technical Field

The present invention relates to an austenitic steel matrix-nanoparticle composite and a producing method thereof.

Related Art

In recent years, there has been a demand for development of a high-strength material for the purpose of improvement in fuel efficiency of a vehicle, reduction in exhaust gas of a vehicle, and absorption of a collision impact of a vehicle or prevention of a damage of a vehicle body. Accordingly, a high-strength steel material capable of achieving a decrease in thickness of a vehicle body through an increase in strength of a vehicle body material and supporting a greater weight by a smaller volume to decrease the weight of the vehicle body has been actively developed.

High-strength steel sheets for a vehicle which are mainly used these days have a tensile strength of 780 MPa or more. However, since an elongation percentage rapidly decreases with the increase in strength and the increase in strength of a steel sheet causes a decrease in moldability, there are problems in that it is difficult to manufacture vehicle components with complicated shapes and the manufacturing process extends even when the same component is manufactured.

Therefore, there is a demand for a steel sheet with a high strength of a tensile strength of 780 MPa or more and with an excellent elongation percentage. With this demand, various composite steel sheets of ferrite-martensite double-phase steel (DP steel) or transformation induced plasticity (TRIP) steel using transformation induced plasticity of residual austenite, or the like have been developed.

In this regard, Korean Patent Application Laid-open No. 10-2008-0065294 discloses a steel material with a high austenite crystal coarsening temperature which includes carbon of less than 0.4 wt %, aluminum of less than 0.06 w %, titanium of less than 0.01 wt %., niobium of 0.01 wt %, vanadium of less than 0.02 wt %, and fine oxide particles of silicon and iron with an average precipitate size of less than 50 nanometer which are distributed in the whole steel microstructures of 5 nanometer to 30 nanometer.

SUMMARY

The present invention is directed to an austenitic steel matrix-nanoparticle composite and a producing method thereof.

However, the problem to be solved by the invention is not limited to the above-mentioned problems, but non-mentioned or other problems will be apparently understood by those skilled in the art.

According to a first aspect of the invention, there is provided an austenitic steel matrix-nanoparticle composite including: an austenitic steel matrix that includes an alloying element; and a nanoparticle that grows in situ in the matrix and that is formed in the matrix, wherein the nanoparticle grows from the alloying element included in the austenitic steel matrix.

According to a second aspect of the invention, there is provided a method of producing an austenitic steel matrix-nanoparticle composite, the method including the steps of: preparing an austenitic steel matrix including an alloying element; and heating the austenitic steel matrix, wherein a nanoparticle grows in situ in the matrix from the alloying element which is solid-dissolved in the austenitic steel matrix by the heating.

According to one of the above-mentioned aspects of the invention, the austenitic steel matrix-nanoparticle composite is a composite having a high strength and a high ductility. Specifically, the austenitic steel matrix-nanoparticle composite exhibits a high strength and a high ductility by securing the high ductility due to the austenitic steel matrix which is used as a vehicle component material and securing the high strength due to a nano-phase in which nanoparticles are formed through in-situ growth by heating the matrix.

The austenitic steel matrix-nanoparticle composite according to the aspect of the invention can be used instead of an existing high-strength vehicle component material and can be substituted for materials such as tool steels and tungsten carbide due to its high hardness of 600 Hv class.

DETAILED DESCRIPTION OF THE INVENTION

Figure 1:
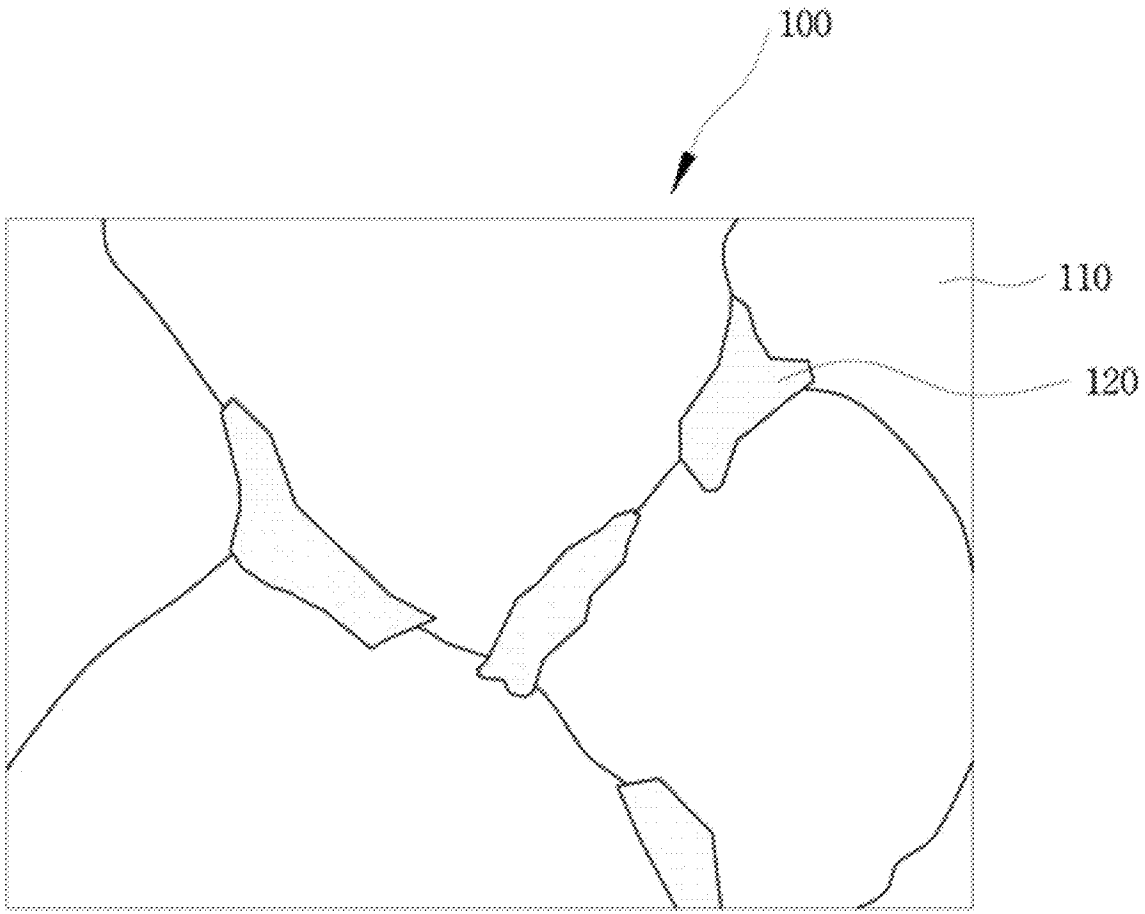
FIG. 1 is a schematic diagram illustrating an austenitic steel matrix-nanoparticle composite according to an embodiment of the present invention.

Hereinafter, embodiments of the present invention will be described in detail with reference to the accompanying drawings such that those skilled in the art can easily put the invention into practice. The invention can be embodied in various forms and is not limited to the embodiments which are described below. For the purpose of clear description of the invention, parts which are not described are omitted and like parts in the specification are referenced by like reference numerals.

In the entire specification, when it is mentioned that an element is "connected" to another element, this mention includes a case in which both elements are "directly connected to each other" and a case in which both elements are "indirectly connected to each other" with still another element interposed therebetween.

In the entire specification, when it is mentioned that an element is located "on" another element, this mention includes a case in which an element comes in contact with another element and a case in which still another element is present between both elements.

In the entire specification, when it is mentioned that an element "includes" another element, this means that the element may further include still another element without excluding still another element unless oppositely described. Terms, "about", "substantially", and the like indicating degrees, which are used in the entire specification when manufacturing errors and material-allowable errors specific to the mentioned meaning are given, are used to prevent an unconscientious infringer from improperly using the disclosed details. Terms such as "step of doing" or "step of" indicating degrees, which are used in the entire specification do not mean "step for".

In the entire specification, the term such as "combination(s) thereof" included in a an expression of the Markush form means a mixture or a combination of one or more elements selected from the group consisting of elements described in the expression of the Markush form and includes one or more elements selected from the group consisting of the elements.

In the entire specification, an expression "A and/or B" means "A, or B, or A and B".

Hereinafter, embodiments of the invention will be described in detail with reference to the accompanying drawings. The invention is not limited to the embodiments and the drawings.

A first aspect of the invention provides an austenitic steel matrix-nanoparticle composite including an austenitic steel matrix that includes an alloying element and a nanoparticle that grows in situ in the matrix and that is formed in the matrix, in which the nanoparticle grows from the alloying element included in the austenitic steel matrix.

The austenite steel is an alloy steel having an austenite structure (FCC crystal structure) and may include $Mn_xFe_y$-$Al_xSi_u$, but the invention is not limited thereto.

FIG. 1 is a schematic diagram illustrating an austenitic steel matrix-nanoparticle composite according to an embodiment of the invention.

As illustrated in FIG. 1, the austenitic steel matrix-nanoparticle composite 100 includes a nano-phase having nanoparticles 120 having grown in situ and having rigidity and strength, which are distributed in an austenitic steel matrix 110 having ductility, and thus can exhibit features such as high strength and high ductility.

In an embodiment of the invention, the alloying element may be solid-dissolved in iron included in the austenitic steel matrix and may include an element which can react with iron to form a compound, but is not limited thereto. For example, the alloying element may include one selected from the group consisting of Mn, Fe, Al, Si, Cr, Mo, Ti, Cu, Ni, Mg, W, and combinations thereof, but the invention is not limited thereto.

In an embodiment of the invention, the nanoparticles may include one selected from the group consisting of Mn, Fe, Al, Si, Cr, Mo, Ti, Cu, Ni, Mg, W, oxides and carbides thereof, and combinations thereof, but the invention is not limited thereto.

In an embodiment of the invention, the size of the nanoparticles may range from about 5 nm to about 50 nm, but is not limited thereto. For example, the size of the nanoparticles ranges from about 5 nm to about 50 nm, ranges from about 5 nm to about 45 nm, ranges from about 5 nm to about 40 nm, ranges from about 5 nm to about 35 nm, ranges from about 5 nm to about 30 nm, ranges from about 5 nm to about 25 nm, ranges from about 5 nm to about 20 nm, ranges from about 5 nm to about 15 nm, ranges from about 5 nm to about 10 nm, ranges from about 10 nm to about 50 nm, ranges from about 15 nm to about 50 nm, ranges from about 20 nm to about 50 nm, ranges from about 25 nm to about 50 nm, ranges from about 30 nm to about 50 nm, ranges from about 35 nm to about 50 nm, ranges from about 40 nm to about 50 nm, or ranges from about 45 nm to about 50 nm, but the invention is not limited thereto.

In an embodiment of the invention, the strength of the austenitic steel matrix-nanoparticle composite may range from about 800 MPa to about 2,500 MPa, but the invention is not limited thereto. For example, the strength ranges from about 800 MPa to about 2,500 MPa, ranges from about 800 MPa to about 2,300 MPa, ranges from about 800 MPa to about 2,000 MPa, ranges from about 800 MPa to about 1,800 MPa, ranges from about 800 MPa to about 1,600 MPa, ranges from about 800 MPa to about 1,400 MPa, ranges from about 800 MPa to about 1,200 MPa, ranges from about 800 MPa to about 1,000 MPa, ranges from about 1,000 MPa to about 2,500 MPa, ranges from about 1,200 MPa to about 2,500 MPa, ranges from about 1,400 MPa to about 2,500 MPa, ranges from about 1,600 MPa to about 2,500 MPa, ranges from about 1,800 MPa to about 2,500 MPa, ranges from about 2,000 MPa to about 2,500 MPa, or ranges from about 2,300 MPa to about 2,500 MPa, but the invention is not limited.

A second aspect of the invention provides a method of producing an austenitic steel matrix-nanoparticle composite, the method including the steps of: preparing an austenitic steel matrix including an alloying element; and heating the austenitic steel matrix, wherein a nanoparticle grows in situ in the matrix from the alloying element which is solid-dissolved in the austenitic steel matrix by the heating.

In an embodiment of the invention, the heating may be performed at about 700° C. to 900° C., but is not limited thereto. For example, the heating is performed at about 700° C. to 900° C., at about 700° C. to 850° C., at about 700° C. to 800° C., at about 700° C. to 750° C., at about 750° C. to 900° C., at about 800° C. to 900° C., or at about 850° C. to 900° C., but the invention is not limited thereto.

In an embodiment of the invention, the alloying element may be solid-dissolved in iron included in the austenitic steel matrix and may include an element which can react with iron to form a compound, but is not limited thereto. For example, the alloying element may include one selected from the group consisting of Mn, Fe, Al, Si, Cr, Mo, Ti, Cu, Ni, Mg, W, and combinations thereof, but the invention is not limited thereto.

In an embodiment of the invention, the nanoparticles may include one selected from the group consisting of Mn, Fe, Al, Si, Cr, Mo, Ti, Cu, Ni, Mg, W, oxides and carbides thereof, and combinations thereof, but the invention is not limited thereto.

In an embodiment of the invention, the size of the nanoparticles may range from about 5 nm to about 50 nm, but is not limited thereto. For example, the size of the nanoparticles ranges from about 5 nm to about 50 nm, ranges from about 5 nm to about 45 nm, ranges from about 5 nm to about 40 nm, ranges from about 5 nm to about 35 nm, ranges from about 5 nm to about 30 nm, ranges from about 5 nm to about 25 nm, ranges from about 5 nm to about 20 nm, ranges from about 5 nm to about 15 nm, ranges from about 5 nm to about 10 nm, ranges from about 10 nm to about 50 nm, ranges from about 15 nm to about 50 nm, ranges from about 20 nm to about 50 nm, ranges from about 25 nm to about 50 nm, ranges from about 30 nm to about 50 nm, ranges from about 35 nm to about 50 nm, ranges from about 40 nm to about 50 nm, or ranges from about 45 nm to about 50 nm, but the invention is not limited thereto.

In an embodiment of the invention, the strength of the austenitic steel matrix-nanoparticle composite may range from about 800 MPa to about 2,500 MPa, but the invention is not limited thereto. For example, the strength ranges from about 800 MPa to about 2,500 MPa, ranges from about 800 MPa to about 2,300 MPa, ranges from about 800 MPa to about 2,000 MPa, ranges from about 800 MPa to about 1,800 MPa, ranges from about 800 MPa to about 1,600 MPa, ranges from about 800 MPa to about 1,400 MPa, ranges from about 800 MPa to about 1,200 MPa, ranges from about 800 MPa to about 1,000 MPa, ranges from about 1,000 MPa to about 2,500 MPa, ranges from about 1,200 MPa to about 2,500 MPa, ranges from about 1,400 MPa to about 2,500 MPa, ranges from about 1,600 MPa to about 2,500 MPa, ranges from about 1,800 MPa to about 2,500 MPa, ranges from about 2,000 MPa to about 2,500 MPa, or ranges from about 2,300 MPa to about 2,500 MPa, but the invention is not limited.

Examples of the invention will be described below. However, the invention is not limited thereto.

EXAMPLES

Solid Dissolution of Alloying Element and Refinement of Crystal Grains Using Milling Process In an example, an attrition milling process was used as a method of solid-dissolving initial powder of Fe, Mn, Al, and Si in Fe and refining crystal grains to produce an austenitic steel matrix-nanoparticle composite.

In the powder composition of this example, 79 wt % of Fe, 15 wt % of Mn, 3 wt % of Al, and 3 wt % of Si were mixed and the ratio of ball and powder was set to 15:1.

Before inputting the mixed powder into a chamber, 2 g of stearic acid and 1.5 kg of stainless balls were input and then the resultant was milled, whereby a lubrication effect of the balls and the chamber was enhanced. The mixed powder was input into a stainless chamber, the inside of the chamber was maintained in a vacuum state, and a milling process thereon was performed in the atmosphere of Ar. The milling process was performed at a speed of 500 rpm for 24 hours and a coolant was made to flow outside the chamber in order to prevent a continuous rise in the temperature of the chamber. During the milling process, the power was repeatedly subjected to plastic deformation, pulverization, and agglomeration (cold welding) through collisions of the mixed powder, the stainless balls, and the blades, whereby mechanical solid dissolution of alloying elements was caused.

After the milling process ended, the inside of the chamber was maintained in the atmosphere of Ar for several hours and was exposed to the air in order to prevent rapid oxidation of the powder. The resultant powder obtained after the milling process was heated in a vacuum state of 500° C. for 20 minutes, whereby residual stearic acid was removed.

In the powder produced in this example, it was seen through the X-ray diffraction (XRD) that the alloying elements were solid-dissolved and the crystal grains were refined.

Sintering Using Spark Plasma Sintering (SPS) Process

A density of the sintered body close to a true density was obtained through the SPS process, the growth of crystal grains was effectively suppressed, and the crystal grains were sintered. In-situ nano-phases were formed during the sintering to produce an austenitic steel matrix-nanoparticle composite. The SPS process was used as the sintering process of this example, but the invention is not limited thereto and various hot molding processes such as hot extrusion, hot rolling, and hot pressing can be used.

The milled powder in this example was sintered through the SPS process. 20 g of the milled powder was input into a graphite mold and the resultant was input into an SPS chamber. The SPS process was performed in a vacuum state of $60\times10^{-3}$ torr in order to prevent oxidation of iron powder. A current was adjusted under a pressure of 70 MPa to raise the temperature to 750° C. at a rate of 80° C./min. The resultant was maintained for 15 minutes under this condition and then was cooled to 300° C. In order to suppress growth of crystal grains, the resultant was subjected to air cooling at 300° C. or lower.

The in-situ nano-phases of the sample produced in this example were observed through a scanning transmission electron microscope (STEM) and XRD analysis.

Figure 2A:
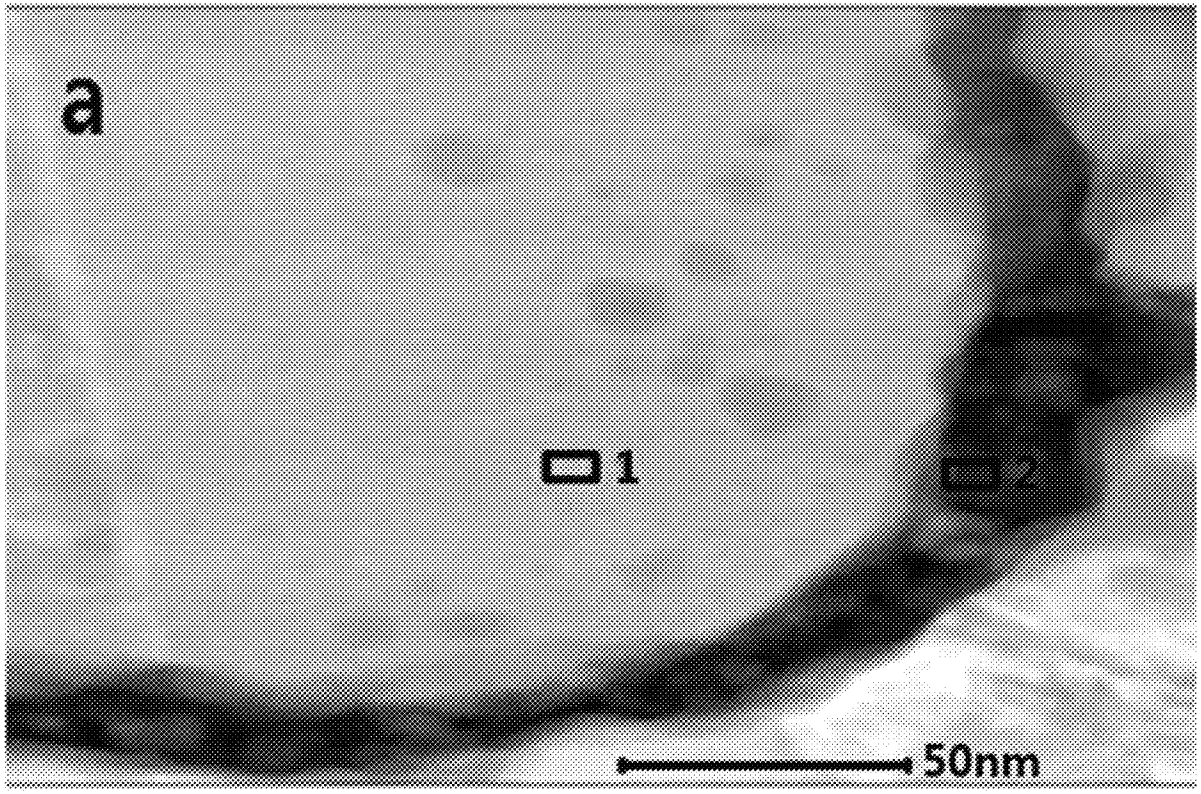
FIGS. 2A, 2B, and 2C are diagrams illustrating a measurement result of the austenitic steel matrix-nanoparticle composite according to the embodiment of the invention using a scanning transmission electron microscope (STEM).
Figure 2B:
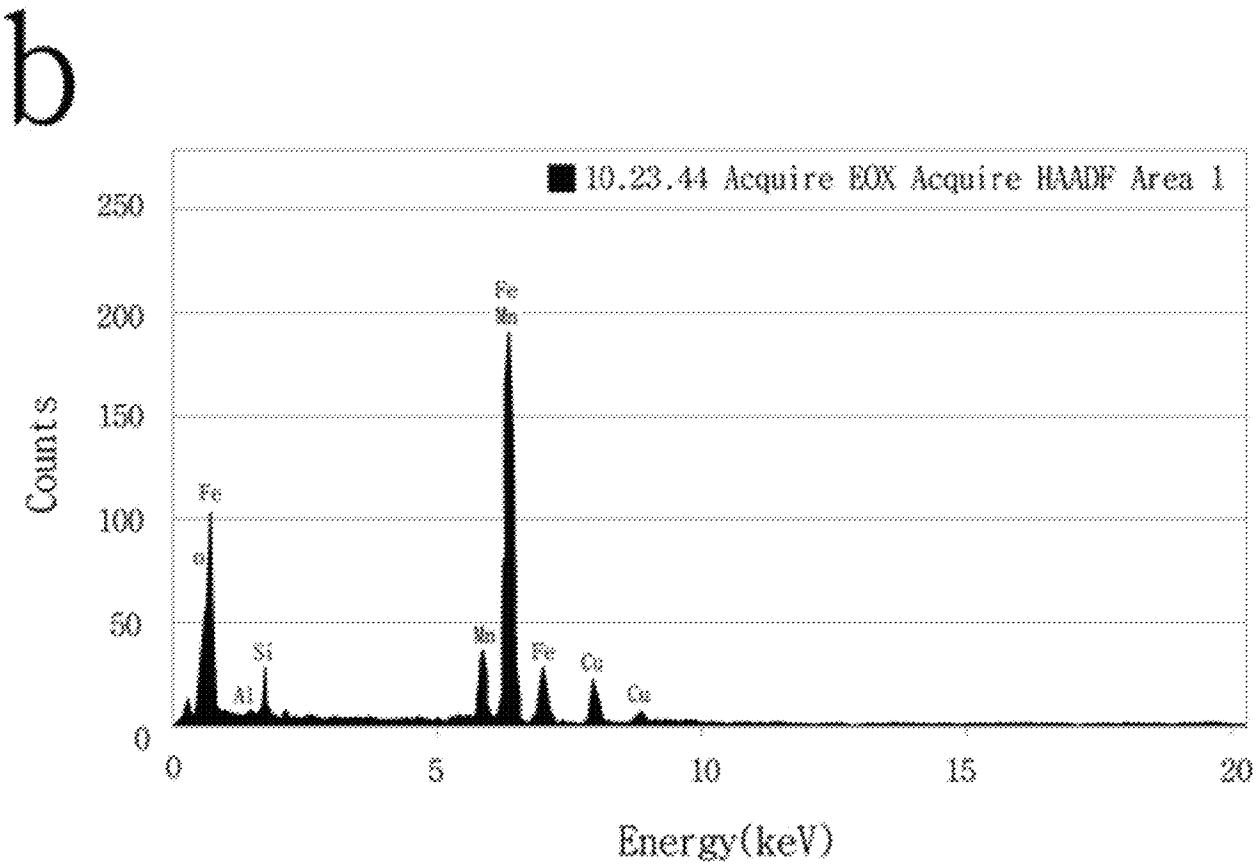
Figure 2C:
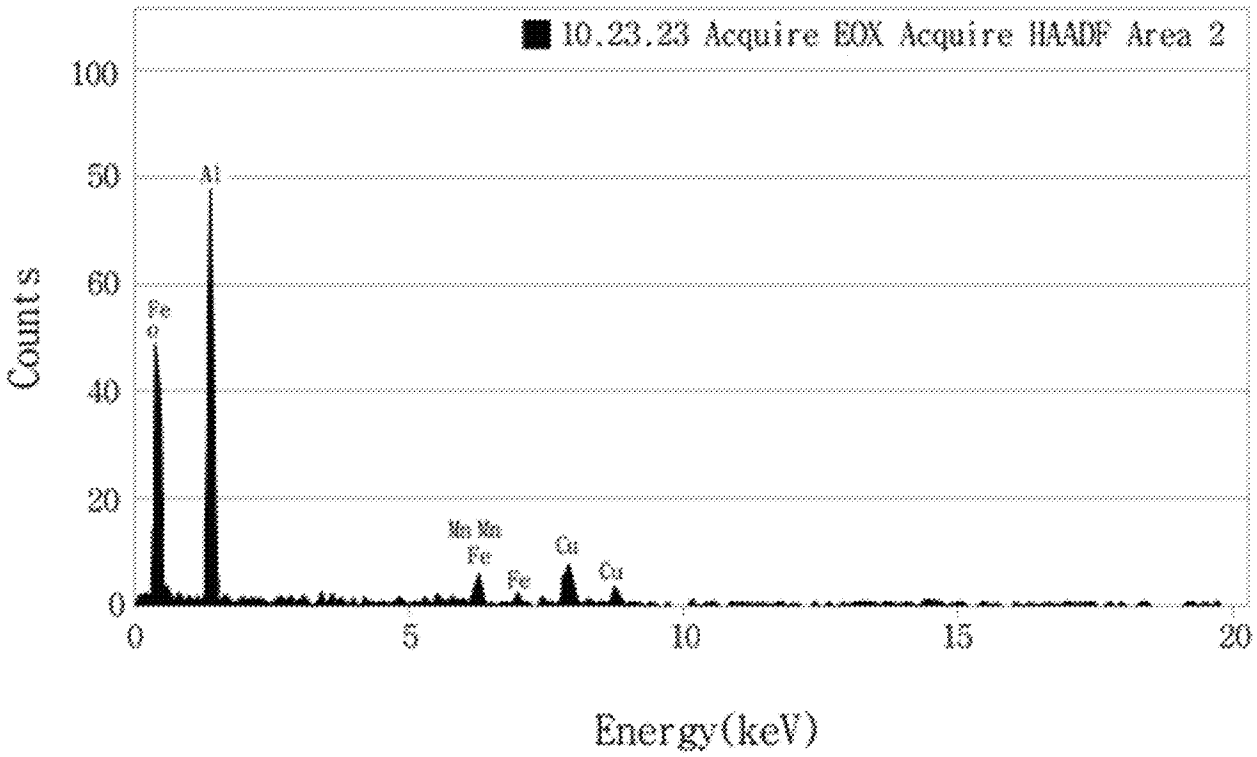

FIG. 2A is a photograph of the austenitic steel matrix-nanoparticle composite using a STEM in an example of the invention, and FIGS. 2B and 2C are diagrams illustrating component analysis results using a STEM.

As illustrated in FIGS. 2A, 2B, and 2C, in the fine structure of the composite, iron and manganese are mainly observed from the matrix parts (FIG. 2B) and aluminum and oxygen are mainly observed from the nanoparticle parts (FIG. 2C).

Figure 3:
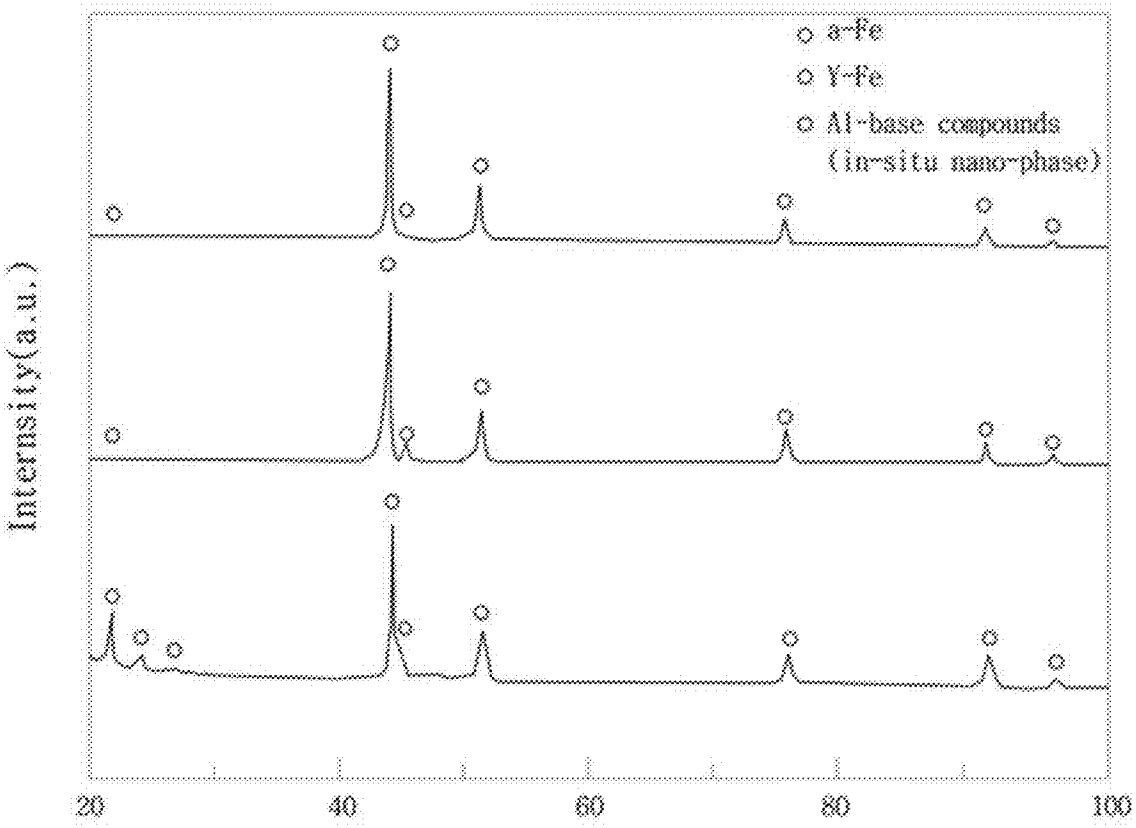
FIG. 3 is a graph illustrating an X-ray diffraction (XRD) measurement result of the austenitic steel matrix-nanoparticle composite according to the embodiment of the invention.

FIG. 3 is a graph illustrating an X-ray diffraction (XRD) measurement result of the austenitic steel matrix-nanoparticle composite which has been subjected to heat treatment at 800° C. in an example of the invention.

As illustrated in FIG. 3, the size of the nanoparticles is small and nothing is not observed in an initial state, but the nanoparticles grows and are clearly observed with an increase in the heating time to 12 hours to 24 hours.

The results of the Vicker's hardness test and the compression test of a sample produced in this example are as follows.

Figure 4:
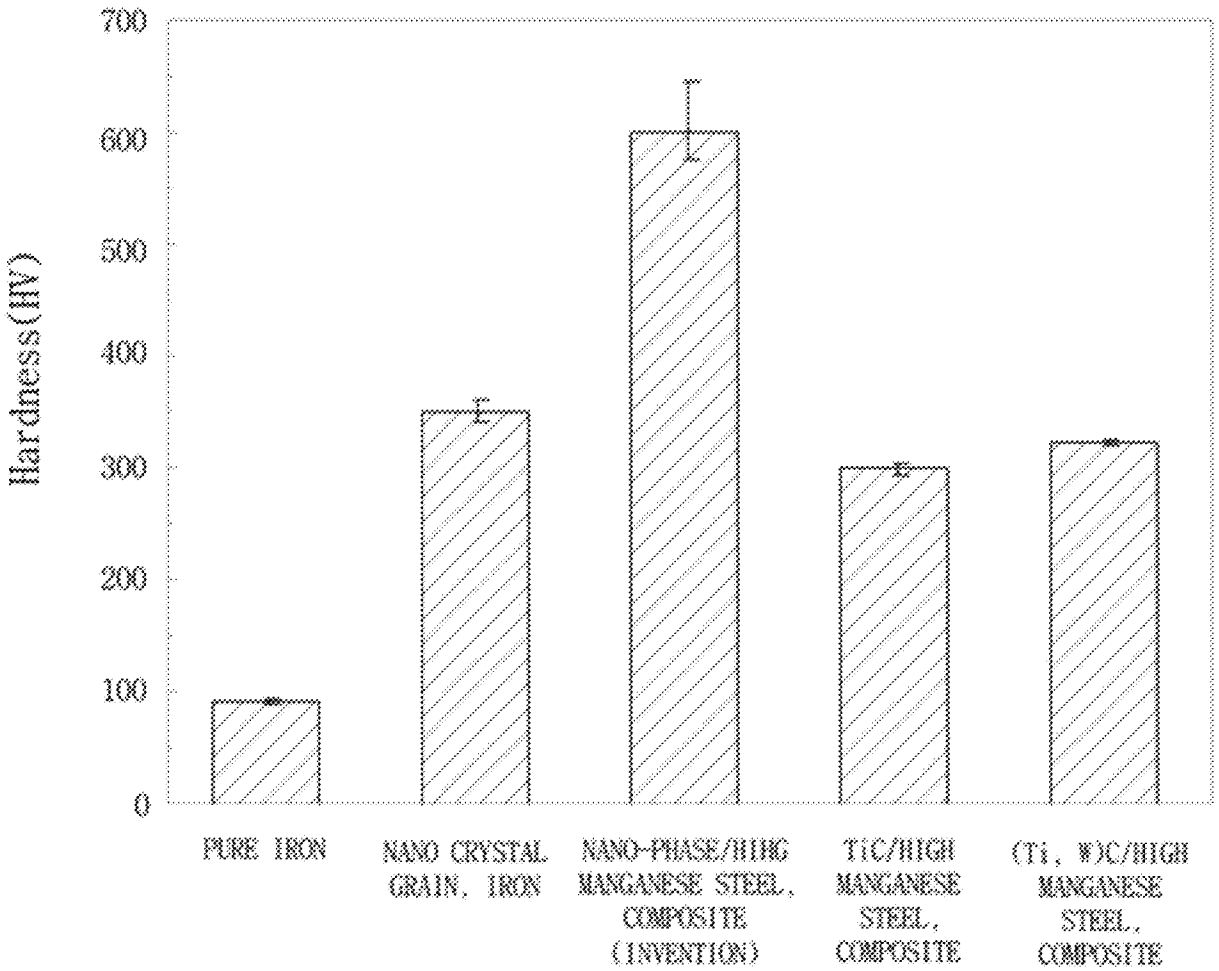
FIG. 4 is a graph illustrating hardness of the austenitic steel matrix-nanoparticle composite according to the embodiment of the invention.

FIG. 4 is a graph illustrating hardness of the austenitic steel matrix-nanoparticle composite according to an example of the invention in comparison with the hardness of other high manganese steel matrix composites in a document published in the past [Srivastava et. al, Microstructural and mechanical characterization of in situ TiC and (Ti,W)C-reinforced high manganese austenitic steel matrix composite, Materials Science and Engineering: A, 516 (2009) pp. 1-6].

As illustrated in FIG. 4, it could be seen that the hardness of the austenitic steel matrix-nanoparticle composite according to this example was about 600 HV which was the highest.

Figure 5:
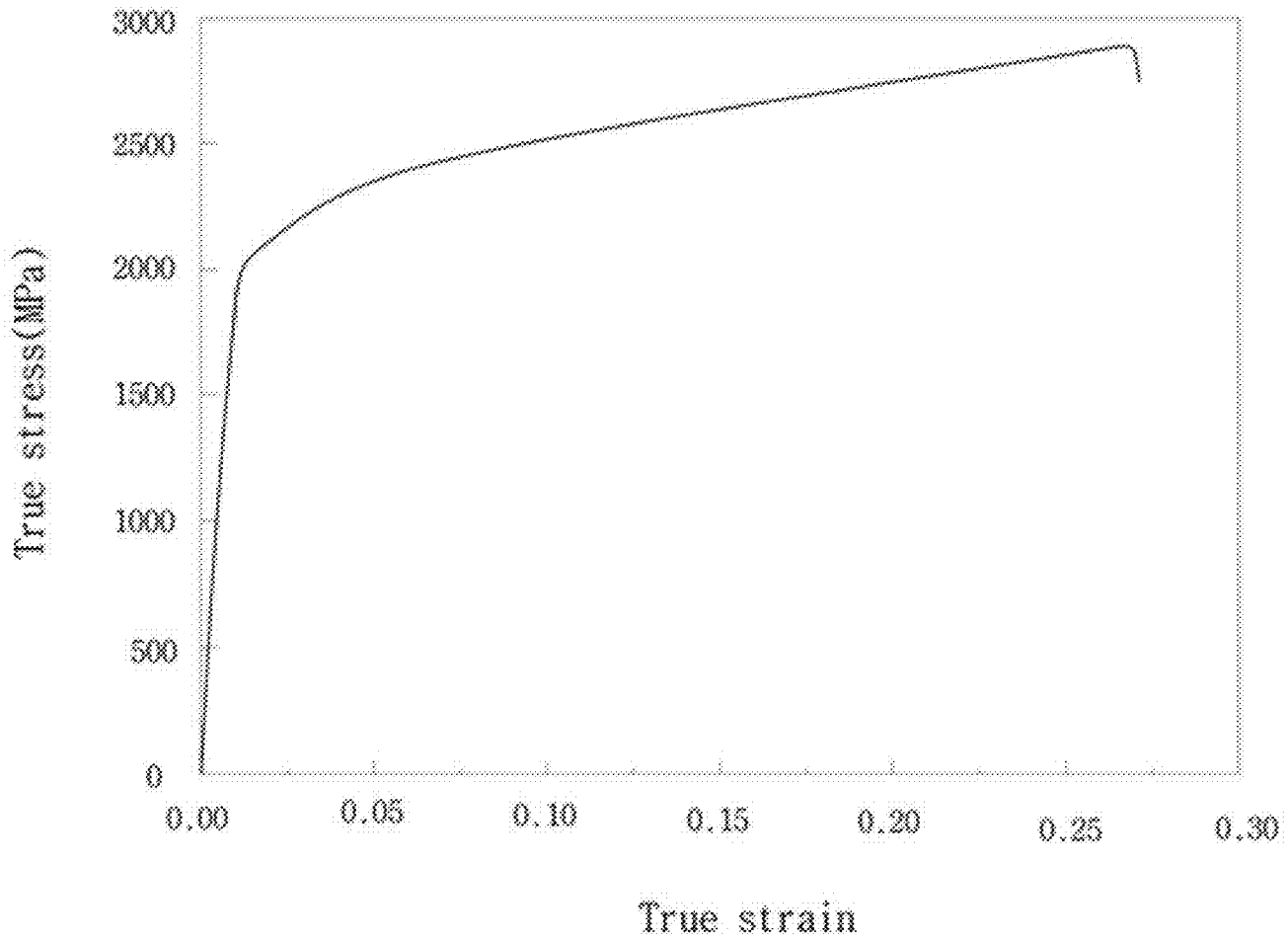
FIG. 5 is a graph illustrating a compression test result of the austenitic steel matrix-nanoparticle composite according to the embodiment of the invention.

FIG. 5 is a graph illustrating the compression test result of the austenitic steel matrix-nanoparticle composite according to an example of the invention.

As illustrated in FIG. 5, the composite of this example exhibited a high strength of 2 GPa or greater due to dispersion of in-situ grown nanoparticles and a high elongation percentage of 25% due to an influence of the high manganese steel matrix.

It could be seen that the austenitic steel matrix-nanoparticle composite of this example exhibits excellent mechanical characteristics such as a high hardness value of about 600 HV, a yield strength of 2,200 MPa, and a high ductility greater than 25%.

The invention is directed to a high-strength and high-ductility composite which is produced by causing a second phase of a nano size to grow in situ in a austenitic steel matrix of a high manganese steel having excellent ductility through heat treatment. The second phase which is distributed in nano-scale was observed using a STEM and the austenite steel, matrix and the nanoparticles were observed using the XRD. It was also seen through the Vicker's hardness test that the composite according to the invention has more excellent hardness than other materials and it was seen through the compression test that a composite with high strength and high ductility was produced.

The description of the invention is exemplary and it will be understood by those skilled in the art that the invention can be modified in various forms without departing from the technical spirit or the essential features of the invention. The above-mentioned embodiments should be understood to be exemplary and not to be limitative. For example, elements described in a single form may be distributed, or elements described to be distributed may be embodied in a coupled form.

The scope of the invention is defined by the appended claims, not by the above-mentioned detailed description, and it should be analyzed that all changes and modifications derived from the meaning, the scope of the claims and the equivalent concept thereof are included in the scope of the invention.

What is claimed is:

1. An austenitic steel matrix-nanoparticle composite comprising:

an austenitic steel matrix that includes an alloying element; and a nanoparticle that grows in situ in a boundary region of the matrix and that is formed in the boundary region of the matrix, wherein the nanoparticle grows from the alloying element included in the austenitic steel matrix, wherein a size of the nanoparticle ranges from 5 nm to 50 nm, wherein the size of the nanoparticle is smaller than a size dividing adjacent crystal grains of the matrix, wherein the austenitic steel matrix-nanoparticle composite is formed by a milling process using a powder of the alloying element, wherein a strength of the austenitic steel matrix-nanoparticle composite ranges from 800 MPa to 2,500 MPa, wherein the alloying element consists of Mn, Fe, Al, and Si, and wherein the nanoparticle includes Al oxides or Si oxides, wherein the Al or Si inhibit the Mn from being oxidized.

* * * * *